US006702909B2

(12) United States Patent
Hales et al.

(10) Patent No.: US 6,702,909 B2
(45) Date of Patent: Mar. 9, 2004

(54) HIGH ENERGY EXPLOSIVE CONTAINING CAST PARTICLES

(75) Inventors: Richard H. Hales, West Jordan, UT (US); Scott B. Preston, Colorado Springs, CO (US); Jared R. Hansen, Framington, MA (US)

(73) Assignee: Dyno Nobel Inc., Salt Lake City, UT (US)

( * ) Notice: Subject to any disclaimer, the term of this patent is extended or adjusted under 35 U.S.C. 154(b) by 0 days.

(21) Appl. No.: 10/133,579

(22) Filed: Apr. 29, 2002

(65) Prior Publication Data

US 2003/0201041 A1 Oct. 30, 2003

(51) Int. Cl.[7] ..... C06B 29/02
(52) U.S. Cl. ..... 149/2; 149/46; 149/77
(58) Field of Search ..... 149/2, 46, 77

(56) References Cited

U.S. PATENT DOCUMENTS

| | | | | | |
|---|---|---|---|---|---|
| 3,765,964 | A | | 10/1973 | Wade | |
| 3,770,522 | A | | 11/1973 | Tomic | |
| 4,310,364 | A | | 1/1982 | Ekman et al. | |
| 4,383,873 | A | | 5/1983 | Wade et al. | |
| 4,453,989 | A | | 6/1984 | Mullay | |
| 4,693,765 | A | * | 9/1987 | Stromquist et al. | 149/46 |
| 4,746,380 | A | * | 5/1988 | Cooper et al. | 149/2 |
| 4,994,124 | A | * | 2/1991 | Nguyen | 149/2 |
| 5,007,973 | A | * | 4/1991 | Trapp et al. | 149/2 |
| 5,074,939 | A | | 12/1991 | Sanders et al. | |
| 5,665,935 | A | | 9/1997 | Stromquist et al. | |
| 5,670,741 | A | | 9/1997 | Stromquist et al. | |
| 5,880,399 | A | | 3/1999 | Hales et al. | |
| 5,972,137 | A | * | 10/1999 | Wypkema et al. | 149/46 |

* cited by examiner

*Primary Examiner*—Edward A. Miller

(57) ABSTRACT

The present invention relates to a water-based explosive having detonation properties similar to dynamite. It comprises an emulsion explosive formed by blending an emulsion phase with cast particles. The emulsion phase comprises a continuous organic liquid fuel phase, a discontinuous inorganic oxidizer solution phase and an emulsifier. The cast particles comprise a mixture of sodium perchlorate, water and diethylene glycol. The cast particles can be added to the emulsion phase before the particles are completely cured and thus before they reach final sensitivty.

8 Claims, No Drawings

HIGH ENERGY EXPLOSIVE CONTAINING CAST PARTICLES

The present invention relates to a water-based explosive having physical and detonation properties similar to dynamite. More specifically it relates to a mixture of a water-in-oil emulsion phase with cast explosive particles and to a method of forming the same.

BACKGROUND

A "Holy Grail" in the modern explosives industry has been to find a water-based explosive to compete with dynamite. Water-based explosives generally are easier to manufacture than dynamites and do not emit fumes that can cause headaches as do dynamites. Unfortunately, water-based explosives do not perform as well as dynamites in certain hard rock and other demanding blasting applications.

A number of approaches and improvements in water-based explosives have been tried, see, for example, U.S. Pat. Nos. 3,770,522; 3,765,964; 4,310,364; 4,383,873; 4,453,989 and 5,074,939. Generally they do not measure up to dynamite in terms of high density, high detonation velocity, low critical diameter, low minimum booster, good air gap sensitivity, high detonation pressure and high energy, and these properties of dynamite are particularly important in certain blasting applications. One reason for the difference is that water-based explosives comprise composite mixtures of oxidizer and fuel ingredients whereas the sensitizing component in dynamites is a molecular explosive, in which the oxidizer and fuel molecules are covalently bound in the same molecule.

The most popular water-based explosives today are emulsion explosives, which comprise a continuous organic liquid fuel phase and a discontinuous oxidizer phase in the form of dispersed droplets of inorganic oxidizer solution. Typically an emulsifier is used to emulsify the solution into droplets. Emulsion explosives generally require air or gas bubbles (or microballoons) for sensitization purposes and thus have a significantly lower density and energy than dynamite. Thus a need exists for emulsion explosives that have a higher density and energy than heretofore available and that perform substantially like dynamite upon detonation. The present invention satisfies this need.

One approach to making emulsion explosives behave more like dynamite is to add to them a molecular explosive, such as PETN particles. Emulsion phases are most easily handled (and particles can more easily be added to and mixed uniformly throughout them) when hot, such as at their formulation temperatures (generally 70° C. or higher), and this is particularly the case if the emulsion phases contain waxes as a part of the fuel phase that increase in viscosity upon cooling. Hazards increase, however, when adding a molecular explosive to a hot emulsion phase. For example, PETN has a lowest DTA exotherm of about 150° C., which would be a safety concern if PETN particles were added to a hot emulsion. The present invention provides a particulate additive that can be added safely to a hot emulsion phase and that imparts higher density and energy to the resulting emulsion explosive.

A safety concern with dynamite or water-based explosives containing molecular explosives is that if left undetonated in a borehole, the molecular explosive component essentially will not degrade over time but will remain an explosive hazard. In seismic applications, for example, often there is considerable time between loading and shooting of the explosive charges. Further, undetonated products can be left inadvertently and by mistake in a borehole and thus the explosive hazard remains. This hazard also could occur if a defective detonator failed to initiate a charge. The explosives of the present invention will degrade by dissolving and/or dispersing with time in a borehole, particularly if in contact with groundwater, and thus will not leave a permanent explosive hazard.

SUMMARY

The emulsion explosives of the present invention are cap-sensitive and have a high energy, detonation velocity and pressure. They comprise a blend of a continuous emulsion phase and a discontinuous phase of cast particles. The emulsion phase is present in an amount by weight of the emulsion explosive of from about 25% to about 95%. The cast particles correspondingly are present in an amount of from about 5% to about 75%. The continuous emulsion phase comprises a continuous organic liquid fuel phase, a discontinuous inorganic oxidizer solution phase of ammonium nitrate and water, and an emulsifier. The cast particles comprise a mixture of from about 50% to about 80% anhydrous sodium perchlorate, from about 0% to about 10% water and from about 10% to about 40% diethylene glycol.

The method of the present invention involves mixing the cast particles throughout the emulsion phase while in their castable state and after or preferably before the particles have completely cured and reached their final sensitivity.

DETAILED DESCRIPTION

The emulsion explosives of the present invention comprise a blend of a water-in-oil emulsion phase with cast particles in a ratio by weight of emulsion phase to cast particles of from about 95:5 to about 25:75. Preferably, the ratio of emulsion phase to cast particles is from about 85:15 to about 40:60 and most preferably from about 75:25 to about 50:50. The ratio of emulsion phase to cast particles will depend on the desired application and on balancing the desired explosive properties with ease of mixing, cost and other factors. As the level of cast particles is increased, the ease of mixing is decreased and the cost is increased, but the detonation properties (such as velocity, energy and pressure) are improved. The emulsion phase comprises a continuous phase of organic liquid fuel, an emulsifier and a discontinuous phase or inorganic oxidizer salt solution. Other additives may be present as described below. The density of the emulsion explosives is from about 1.10 g/cc to about 1.60 g/cc and preferably is above 1.40 g/cc.

The immiscible organic fuel forming the continuous phase of the emulsion phase is present in an amount of from about 3% to about 12%, and preferably in an amount of from about 4% to about 8% by weight of the emulsion phase. The actual amount used can be varied depending upon the particular immiscible fuel(s) used and upon the presence of other fuels, if any. The immiscible organic fuels can be aliphatic, alicyclic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cottonseed oil, peanut oil, and soybean oil. Particularly preferred liquid fuels are mineral oil, No. 2 fuel oil, paraffin waxes, microcrystalline waxes, and mixtures thereof. Aliphatic and aromatic nitrocompounds and chlorinated hydrocarbons also can be used. Mixtures of any of the above can be used.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed below. These additional solid and/or liquid fuels can be added generally in amounts ranging up to about 25% by weight. If desired, undissolved oxidizer salt can be added to the composition along with any solid or liquid fuels.

The inorganic oxidizer salt solution forming the discontinuous phase of the emulsion phase generally comprises inorganic oxidizer salt, in an amount from about 45% to about 95% by weight of the emulsion phase, and water and/or water-miscible organic liquids, in an amount of from about 0% to about 30%. The oxidizer salt preferably is primarily ammonium nitrate (AN), but other salts may be used in amounts up to about 50% of the total salts. The other oxidizer salts are selected from the group consisting of ammonium, alkali and alkaline earth metal nitrates, chlorates and perchlorates. Of these, sodium nitrate (SN) and calcium nitrate (CN) are preferred. AN and ANFO prills also can be added in solid form as part of the oxidizer salt in the final composition.

Water generally is employed in an amount of from 3% to about 30% by weight of the emulsion phase. It is commonly employed in emulsions in an amount of from about 5% to about 20%, although emulsions can be formulated that are essentially devoid of water.

Water-miscible organic liquids can at least partially replace water as a solvent for the salts, and such liquids also function as a fuel for the composition. Moreover, certain organic compounds also reduce the crystallization temperature of the oxidizer salts in solution. Soluble or miscible solid or liquid fuels can include alcohols such as methyl alcohol, glycols such as ethylene glycols, polyols such as sugars, amides such as formamide, amines, amine nitrates, urea and analogous nitrogen-containing fuels. As is well known in the art, the amount and type of water-miscible liquid(s) or solid(s) used can vary according to desired physical properties.

An emulsifier is used in forming the emulsion and typically is present in an amount of from about 0.2% to about 5% by weight of the emulsion phase. Typical emulsifiers include sorbitan fatty esters, glycol esters, substituted oxazolines, alkylamines or their salts, derivatives thereof and the like. More recently, certain polymeric emulsifiers have been found to impart better stability to emulsions under certain conditions. U.S. Pat. No. 4,820,361 describes a polymeric emulsifier derivatized from trishydroxymethylaminomethane and polyisobutenyl succinic anhydride ("PIBSA"), which is particularly effective in combination with organic microspheres and is a preferred emulsifier. U.S. Pat. No. 4,784,706 discloses a phenolic derivative of polypropene or polybutene. Other derivatives of polypropene or polybutene have been disclosed. Preferably the polymeric emulsifier comprises polymeric amines and their salts or an amine, alkanolamine or polyol derivative of a carboxylated or anhydride derivatized olefinic or vinyl addition polymer. U.S. Pat. No. 4,931,110 discloses a polymeric emulsifier comprising a bis-alkanolamine or bis-polyol derivative or a bis-carboxylated or anhydride derivatized olefinic or vinyl addition polymer in which the olefinic or vinyl addition polymer chain has an average chain length of from about 10 to about 32 carbon atoms, excluding side chains or branching.

The emulsion phase of the present invention may be formulated in a conventional manner as is known in the art. Typically, the oxidizer salt(s) first is dissolved in the water (or aqueous solution of water and miscible liquid fuel) at an elevated temperature of from about 25° C. to about 90° C. or higher, depending upon the crystallization temperature of the salt solution. The aqueous oxidizer solution then is added to a solution of the emulsifier and the immiscible liquid organic fuel, which solutions preferably are at the same elevated temperature, and the resulting mixture is stirred with sufficient vigor to produce an emulsion of the aqueous solution in a continuous liquid hydrocarbon fuel phase. Usually this can be accomplished essentially instantaneously with rapid stirring. (The compositions also can be prepared by adding the liquid organic to the aqueous oxidizer solution.) Stirring should be continued until the formulation is uniform. The formulation process also can be accomplished in a continuous manner as is known in the art.

It is advantageous to predissolve the emulsifier in the liquid organic fuel prior to adding the organic fuel to the aqueous solution. This method allows the emulsion to form quickly and with minimum agitation. However, the emulsifier may be added separately as a third component if desired.

The particulate additive of the present invention is described in commonly-owned U.S. Pat. Nos. 5,665,935; 5,670,741 and 5,880,399. It comprises a mixture primarily of sodium perchlorate particles, diethylene glycol, preferably some water, and optionally microballoons. As described in these patents, the combination of these ingredients provides a cast, solid explosive composition. The ingredients can be combined and mixed at ambient temperatures to produce a somewhat fluid slurry that can be formed into pellets or particles. When initially formed the mixture is not a cap-sensitive explosive, but upon curing the mixture casts and increases in sensitivity to become a cap-sensitive explosive. It is believed that this is because intimacy of the liquid organic fuel and the solid perchlorate oxidizer takes place over time as the liquid fuel is absorbed into the solid oxidizer crystals. In its cast form it behaves in some respects like a molecular explosive, i.e., it has a high density, high detonation velocity, lower critical diameter, low minimum booster, high detonation pressure and high energy. The mixture now has been found to exhibit these properties even in particle form. Thus the cast particles can be added to an emulsion phase, just like molecular explosive particles as described in the Background section above, to form a high energy and density emulsion explosive. Moreover, the cast particles can be added to the emulsion phase while rigid enough to retain their shape but while not yet fully cured and thus not at their final sensitivity. Thus they can be handled more safely than molecular explosive particles. Further, the cast particles are more thermally stable than most common molecular explosives such as PETN, since the cast particles have a lowest DTA exotherm of around 270° C.

The cast particles comprise sodium perchlorate in an amount of from about 50% to about 80% by weight of the particles, diethylene glycol in an amount of from about 10% to about 40%, and water from about 0% to about 10%. The diethylene glycol (DEG) may contain minor amounts of other homologous glycols such as triethylene glycol (TEG), which also may be added separately.

The sodium perchlorate is added in dry, particulate or crystal form, although a minor amount also may be dissolved in the diethylene glycol and/or water. Minor amounts may be added of other inorganic oxidizer salts selected from the group consisting of ammonium, alkali and alkaline earth metal nitrates, chlorates and perchlorates.

Preferably, a thickening agent is added to the cast particles during their formation to influence their rheology and casting manner and time. A preferred thickener is Xanthan gum, although the thickening agent may be selected from the group consisting of galactomannan gums, biopolymer gums, guar gum of reduced molecular weight, polyacrylamide and analogous synthetic thickeners, flours and starches. Thickening agents generally are used in amounts ranging from about 0.02% to about 0.2%, but flours and starches may be employed in greater amounts, in which case they also function as fuels. Mixtures of thickening agents can be used.

Other solid and/or liquid fuels such as aluminum and ethylene glycol or other oxygen-bearing organic fuels can be added to the particles depending upon the properties desired.

As described in U.S. Pat. No. 5,880,399, which is incorporated herein by reference, the cast particles are prepared as follows. The sodium perchlorate particles or crystals ("solid portion") are mixed with a solution of water (if used) and diethylene glycol ("liquid portion"), and optionally a slurry of microballoons (if used) in diethylene glycol and water (if used) ("second liquid portion"). The thickening agent, if used, preferably is pre-hydrated in the liquid portion prior to adding the other portion(s). The preferred method of formulation is to add the solid portion to the liquid portion and then add the second liquid portion to the slurry thus formed. Optionally, the two liquid portions can be combined before adding the solid portion. Following addition of the portions, simple mixing occurs in a manner sufficient to form a uniform slurry, which then can be formed into particles of desired size and shape during the casting process. Basically, the method of manufacture can involve any slow, folding type of blending typical for adding solids to viscous liquids.

The size or size range of the cast particles can vary for practical reasons depending upon ease of manufacture and of mixing with the emulsion phase. Particle size can vary from 2–3 mm in diameter up to 25 mm in diameter or larger. A preferred particle size range is from about 10% to about 33% of the diameter of the emulsion explosive charge, up to a maximum particle size of about 25 mm in effective diameter. The shape also can vary for practical reasons such as ease of manufacture of the cast particles. Shapes that have been tested include roughly cubical, cylindrical and hemisperical.

Though not required, microballoons can be added to the emulsion phase to sensitize it to initiation. They also can be added to the cast particles for the benefits described in U.S. Pat. No. 5,880,399. The microballoons preferably are plastic microspheres having a nonpolar surface and comprising homo-, co- or terpolymers of vinyl monomers. A preferred composition of the plastic microspheres is a thermoplastic copolymer of acrylonitrile and vinylidine chloride. Additionally, the microballons may be made from siliceous (silicate-based), ceramic (aluminosilicate) glass such as soda-lime-borosilicate glass, polystyrene, perlite or mineral perlite material. Further, the surface of any of these microballoons may be modified with organic monomers or homo-, co- or terpolymers of vinyl or other monomers, or with polymers of inorganic monomers. In the cast particles, microballoons preferably are employed in an amount of from about 0.05% to about 1.6% by weight, and plastic microballoons preferably are employed in an amount of less than about 0.5%. In the emulsion phase, microballoons preferably are employed in an amount of from about 0.1% to about 1% for plastic microballoons or 1% to 6% for glass microballoons. Chemical gassing agents also can be used in the emulsion as is known in the art.

The method of the present invention involves combining the emulsion phase with the cast particles to form a cap-sensitive, high energy emulsion explosive also having high detonation velocity and pressure. The method comprises (a) forming an emulsion phase at an elevated temperature as described above, (b) forming castable particles in the manner and with the composition described above and (c) mixing the castable particles throughout the emulsion phase preferably before the particles have reached their final sensitivity. In this manner the cast particles can be mixed into the emulsion phase while they are rigid enough to retain their shape but while not yet fully cured and thus not at their final sensitivity. This allows for safer mixing of the emulsion phase and the ultimately cast particles, due to this unique nature of the particles as they cure. Thus an emulsion explosive that has properties similar to dynamite or water-based explosives sensitized with molecular explosives can be handled safely and without ever handling a molecular explosive.

The fact that the cast particles effectively sensitize the emulsion phase, similar to what molecular explosive particles would do, is somewhat surprising. The cast particles are miscible or highly soluble with water and are hygroscopic under humid conditions. Thus the particles would not be expected to be compatible with a water-based emulsion phase because they would be expected to absorb water from the emulsion phase, thereby destabilizing the phase and causing it to crystallize. Correspondingly, the cast particles would be expected to decrease in sensitivity as they absorbed water. These phenomena, however, are found not to occur in lower water emulsion phases, particularly when waxes are used as part of the fuel component. Further, the cast particles do not exhibit all properties typical of molecular explosives. For example, the critical diameters of most molecular explosives are significantly lower than those for the cast particles, even after microballoons are added. In addition, the detonation run-up distances for the cast particles generally are higher than those for molecular explosives.

The invention can be further illustrated by reference to the following examples and tables. In the tables the following key applies: "MB" stands for minimum booster in the cylindrical size and with the detonator strength indicated. "dc" is critical diameter in the charge size indicated. "D" is detonation velocity in the sizes indicated when initiated with a detonator or booster of the strength or size indicated (3C=454 grams pentolite). The "#6e" refers to a commercial #6 electric detonator, while #6, #3, #2, etc. refer to non-commercial detonators manufactured with 6, 3, 2, etc. grains of loose PETN, respectively. All detonation velocities are "unconfined" detonation velocities and hence are lower, particularly in smaller charge diameters, than would be their calculated theoretical detonation velocities.

EXAMPLE 1

In Table 1 below, detonation results are shown (a) for a sensitized emulsion phase having the composition shown and (b) for the same emulsion phase blended 50/50 by weight with cast particles in both cubed and cylindrical shapes. The blends showed improvement in detonation velocity and minimum booster (MB) over the emulsion phase and at a significantly higher density.

EXAMPLE 2

Table 2 shows detonation results of a sensitized emulsion phase alone, the same emulsion phase combined 50/50 with cast particles and an unsensitized emulsion phase combined 50/50 with cast particles. The emulsion phases contained waxes as part of the continuous "oil" phase. Waxes are found to increase the storage stability of the blends. In this example the cast particles did not contain microballoons. Even with an unsensitized emulsion phase, a much lower MB was observed as well as a lower critical diameter and improvement in detonation velocity at both higher (75 mm) and lower (32 mm) diameters. When stored over a sixteen week period, the 50/50 sensitized emulsion particle mixture (2) exhibited no significant loss in detonation properties and no significant change in stability of the cast particles and of the emulsion phase.

EXAMPLE 3

Table 3 gives detonation results of various blends of emulsion phase with cast particles. Even with only 10% cast particles in an unsensitized emulsion phase (2), a low MB and a velocity approaching 3000 meters/second were obtained in a 50 mm diameter. Detonation properties improve with increasing levels of cast particles.

EXAMPLE 4

Table 4 gives the detonation results for an even broader range of blends of emulsion phase with cast particles. Cap sensitivity and detonation velocities of approximately 3,000 meters/second in the 75–100 mm diameter range were observed even with only 5% cast particles present in an unsensitized emulsion. Also, blends with as much as 75 percent cast particles could be achieved, although with a lower density due to the incorporation of air into the mixture with such high particle loading. The practical density of such mixtures could easily be raised utilizing vacuum loading procedures known in the art. In addition, this Table shows no significant loss in detonation properties at −20° C. for emulsion phase/cast particle blends with 20 percent cast particles and above.

EXAMPLE 5

Table 5 illustrates that the addition of cast particles to an emulsion phase has a significant effect on theoretical (calculated) detonation properties. For example, compare mix 4 with mix 7. The values are increased even more when the cast particles are mixed with an unsensitized emulsion phase (compare mix 4 to mix 8). Mixes 8–12 show that the theoretical (calculated) detonation properties can be varied by varying the level of particles in the emulsion in order to match a range of practical applications.

EXAMPLE 6

Table 6 shows the effect that different sizes of cast particles have on detonation properties. At the higher cast particles level of 33.3% by weight, the particle size did not have much effect on the detonation properties, but the small particles produced better results at the 20% by weight level in the smaller charge diameters (32 and 25 mm). This may have been due to the fact that uniform mixing was more difficult to achieve with the larger particles in the smaller diameter charges.

EXAMPLE 7

Table 7 gives further examples of emulsion phase and cast particle blends in the 80/20 to 66.67/33.33 range wherein a higher level of water (10.39 percent) was used in the emulsion. High densities and detonation results (comparable to those in blends having lower water levels) were obtained as well as excellent shooting results at −20° C.

EXAMPLE 8

Table 8 shows roughly the effect of cast particle aging on detonation properties and shows that the cast particles become more sensitive with time and curing. The cast particles were hemispherically shaped and were formed by pouring the pre-cured mixture of cast particles ingredients on a rubber belt molded with dimples. Prior to complete curing but while somewhat rigid, the particles were removed from the belt and mixed into the emulsion phase. The emulsion phase and cast particles blend then was tested at approximately two hours (at 50° C.) and then again at approximately four hours (at 30° C.) after removing the particles from the belt. The detonation velocity is seen to improve in the smaller diameters even though the temperature of the blend was lower at the four-hour test (mixes 1 and 2). These results are compared to a fresh blend at 50° C. made with aged particles (mix 3) where an even further improvement in detonation velocity was obtained.

Because of the relatively high density and sensitivity of these emulsion explosives, and other detonation parameters, they are particularly useful as a booster or primer or as a seismic explosive. In other words, they can be used as replacements for dynamites, molecular explosives or water-based explosives that contain molecular explosives. They can be packaged in sizes, shapes and packagings as is known in the art.

While the present invention has been described with reference to certain illustrative examples and preferred embodiments, various modifications will be apparent to those skilled in the art and any such modifications are intended to be within the scope of the invention as set forth in the appended claims.

TABLE 1

| | Sensitized | 50/50 Emulsion/Particles | |
|---|---|---|---|
| | Emulsion | Cubes[1] | Cylinders[2] |
| Emulsion Phase | | | |
| AN | 75.69 | 37.84 | 37.84 |
| $H_20$ | 17.75 | 8.88 | 8.88 |
| Polymeric Emulsifier | 1.19 | 0.60 | 0.60 |
| Mineral Oil | 4.77 | 2.38 | 2.38 |
| Plastic Microballoons | 0.60 | 0.30 | 0.30 |
| Cast Particles | | | |
| NaP | — | 35.46 | 35.46 |
| DEG | — | 12.24 | 12.24 |
| $H_20$ | — | 2.11 | 2.11 |
| TEG | — | 0.06 | 0.06 |
| Gum | — | 0.02 | 0.02 |
| Plastic Microballoons | — | 0.11 | 0.11 |
| Density (g/cc) | 0.99 | 1.23 | 1.23 |
| Results At 20° C. | | | |
| MB, 75 mm (Det/Fail) | #6e/#6 | #3/— | #2/#1 |
| D, 3C (km/s) | | | |
| 75 mm | 5.4 | 5.7 | 5.9 |
| 63 mm | 5.0 | 5.7 | 5.9 |
| 50 mm | — | 6.0 | 5.6 |
| 38 mm | — | — | 5.5 |
| 25 mm | — | — | 5.5 |
| 19 mm | — | — | 5.0 |

[1]Approximately 13 mm × 13 mm × 13 mm but individual particles varied.
[2]Approximately 6 mm diameter × 6 mm long but individual particles varied.

TABLE 2

| | | 50/50 Emulsion/Particles | |
|---|---|---|---|
| | Sensitized Emulsion 1 | Sensitized Emulsion[1] 2 | Unsensitized Emulsion[2] 3 |
| Emulsion Phase | | | |
| AN | 65.85 | 32.92 | 33.94 |
| SN | 16.60 | 8.30 | 8.55 |
| Urea | 4.19 | 2.10 | 2.16 |
| $H_20$ | 4.56 | 2.28 | 2.35 |
| Polymeric Emulsifier | 2.03 | 1.02 | 0.63 |
| Mineral Oil | 2.03 | 1.02 | 1.47 |
| Amber Wax | 0.87 | 0.43 | 0.45 |
| Paraffin Wax | 0.87 | 0.43 | 0.45 |
| Glass Microballoons | 3.00 | 1.50 | — |
| Cast Particles | | | |
| NaP | — | 35.65 | 35.65 |
| DEG | — | 12.28 | 12.28 |
| $H_20$ | — | 1.99 | 1.99 |
| TEG | — | 0.06 | 0.06 |
| Xanthan Gum | — | 0.02 | 0.02 |
| Oxygen Balance (%) | −1.31 | −0.65 | −0.70 |
| Density (g/cc) | 1.19 | 1.38 | 1.57 |
| Results at 20° C. | | | |
| MB, 75 mm (Det/Fail) | #8/#6e | #1/#0.5 | #1/#0.5 |
| $d_c$ Det/Fail (mm) | 32/25 | 25/— | 25/— |
| D, #12 (km/s) | | | |
| 75 mm | 5.4 | 5.9 | 6.0 |
| 63 mm | 5.4 | 6.0 | 5.4 |
| 50 mm | 5.4 | 5.8 | 5.4 |
| 38 mm | 5.0 | 5.6 | 5.1 |

TABLE 2-continued

| | | 50/50 Emulsion/Particles | |
|---|---|---|---|
| | Sensitized Emulsion 1 | Sensitized Emulsion[1] 2 | Unsensitized Emulsion[2] 3 |
| 32 mm | 4.8 | 5.5 | 5.0 |
| 25 mm | Fail | 5.2 | 4.5 |

[1]Cast particles in cylinders approximately 6 mm diameter × 6 mm long.
[2]Cast particles in cylinders approximately 10 mm diameter × 13 mm long.

TABLE 3

| | 1 | 2 | 3 | 4 | 5 | 6 | 7[3] |
|---|---|---|---|---|---|---|---|
| Emulsion Phase[1] | 100.00 | 90.00 | 80.00 | 70.00 | 60.00 | 50.00 | 0.00 |
| Cast Particles[2] | 0.00 | 10.00 | 20.00 | 30.00 | 40.00 | 50.00 | 100.00 |
| Oxygen Balance (%) | −1.42 | −1.27 | −1.13 | −0.99 | −0.84 | −0.70 | +0.02 |
| Density (g/cc) | 1.43 | 1.44 | 1.44 | 1.46 | 1.48 | 1.50 | 1.78 |
| Results at 20° C. | | | | | | | |
| MB, 75 mm (Det/Fail) | —/3C | #3/#2 | #2/#1 | #1/— | #1/— | #0.5/— | #0.5/— |
| D, 90 g (km/s) | | | | | | | |
| 75 mm | Fail | — | 3.97 | 4.78 | — | — | — |
| 50 mm | Fail | 2.71 | — | 4.22 | 4.95 | 5.07 | 6.32 |

[1]Emulsion: AN (67.87), SN (17.11), Urea, (4.32), $H_2O$ (4.70), polymeric emulsifier (1.26), mineral oil (2.94), Amber Wax (0.90), Paraffin Wax (0.90).
[2]Cast Particles: NaP (71.30), DEG (24.55), H2O (3.99), TEG (0.12), Xanthan Gum (0.04)
[3]Results for a solid cast cylinder (not particles)

TABLE 4

| | 1 | 2 | 3 | 4 | 5 | 6 | 7 | 8 | 9 |
|---|---|---|---|---|---|---|---|---|---|
| Emulsion Phase[3] | 95.00 | 90.00 | 85.00 | 80.00 | 75.00 | 66.67 | 40.00 | 33.33 | 25.00 |
| Cast Particles[4] | 5.00 | 10.00 | 15.00 | 20.00 | 25.00 | 33.33 | 60.00 | 66.67 | 75.00 |
| Oxygen Balance (%) | −1.34 | −1.27 | −1.20 | −1.13 | −1.06 | −0.94 | −0.56 | −0.46 | −0.34 |
| Density (g/cc) | 1.48 | 1.48 | 1.49 | 1.47 | 1.52 | 1.54 | 1.53 | 1.55 | 1.32 |
| Results at 5° C. | | | | | | | | | |
| MB, 100 mm (Det/Fail) | #6/#4 | #3/#2 | #3/#2 | — | — | — | — | — | — |
| D, #12 (km/s) | | | | | | | | | |
| 100 mm | 2.8 | 3.4 | 4.2 | — | — | — | — | — | — |
| 75 mm | 3.9 | 3.5 | 3.8 | 4.1 | — | 4.7 | — | — | — |
| 63 mm | — | 3.3 | 3.5 | 3.9 | — | 4.6 | — | — | — |
| 50 mm | — | 3.2 | 3.4 | 4.0 | — | 4.4 | 5.4 | 5.6 | 4.8 |
| 38 mm | — | — | — | 3.8 | — | 4.3 | — | — | — |
| 32 mm | — | — | — | 2.8 | — | 4.1 | — | — | — |
| 25 mm | — | — | — | 2.4 | — | 5.0 | — | — | — |
| Results at −20° C. | | | | | | | | | |
| MB, 38 mm (Det/Fail) | — | — | — | #12/— | #2/#1 | #12/— | — | — | — |
| D, #12 (km/s) | | | | | | | | | |
| 75 mm | — | — | — | 4.2 | 4.5 | 4.9 | — | — | — |
| 63 mm | — | — | — | 4.1 | 4.5 | 4.8 | — | — | — |
| 50 mm | — | — | — | 3.7 | 4.0 | 4.5 | — | — | — |
| 38 mm | — | — | — | 4.0 | 3.8 | 4.2 | — | — | — |
| 32 mm | — | — | — | 3.2 | 3.8 | 4.2 | — | — | — |
| 25 mm | — | — | — | — | 3.8 | 3.5 | — | — | — |

[3]AN (67.87), SN (17.11), Urea (4.32), $H_2O$ (4.70), polymeric emulsifier (1.26), mineral oil (2.94), Amber Wax (0.90), Paraffin Wax (0.90)
[4]NaP (71.30), DEG (24.55), $H_2O$ (3.99), TEG (0.12), Xanthan Gum (0.04). Hemispherical shape, 10 mm diameter.

TABLE 5

| | Theoretical (Calculated) Properties | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Emulsion Phase | | | | | | | | | | | | |
| AN | 75.69 | — | 75.69 | 65.85 | 67.88 | — | 65.85 | 67.88 | 67.88 | 67.88 | 67.88 | 67.88 |
| SN | — | — | — | 16.60 | 17.10 | — | 16.60 | 17.10 | 17.10 | 17.10 | 17.10 | 17.10 |
| Urea | — | — | — | 4.19 | 4.32 | — | 4.19 | 4.32 | 4.32 | 4.32 | 4.32 | 4.32 |
| $H_20$ | 17.75 | — | 17.75 | 4.56 | 4.70 | — | 4.56 | 4.70 | 4.70 | 4.70 | 4.70 | 4.70 |
| Polymeric Emulsifier | 1.19 | — | 1.19 | 2.03 | 1.26 | — | 2.03 | 1.26 | 1.26 | 1.26 | 1.26 | 1.26 |
| Mineral Oil | 4.77 | — | 4.77 | 2.03 | 2.94 | — | 2.03 | 2.94 | 2.94 | 2.94 | 2.94 | 2.94 |
| Amber Wax | — | — | — | 0.87 | 0.90 | — | 0.87 | 0.90 | 0.90 | 0.90 | 0.90 | 0.90 |
| Paraffin Wax | — | — | — | 0.87 | 0.90 | — | 0.87 | 0.90 | 0.90 | 0.90 | 0.90 | 0.90 |
| Plastic Microballoons | 0.60 | — | 0.60 | — | — | — | — | — | — | — | — | — |
| Glass Microballoons | — | — | — | 3.00 | — | — | 3.00 | — | — | — | — | — |
| Cast Particles | | | | | | | | | | | | |
| NaP | — | 70.91 | 70.91 | — | — | 71.30 | 71.30 | 71.30 | 71.30 | 71.30 | 71.30 | 71.30 |
| DEG | — | 24.49 | 24.49 | — | — | 24.55 | 24.55 | 24.55 | 24.55 | 24.55 | 24.55 | 24.55 |
| $H_20$ | — | 4.22 | 4.22 | — | — | 3.99 | 3.99 | 3.99 | 3.99 | 3.99 | 3.99 | 3.99 |
| TEG | — | 0.13 | 0.13 | — | — | 0.12 | 0.12 | 0.12 | 0.12 | 0.12 | 0.12 | 0.12 |
| Xanthan Gum | — | 0.04 | 0.04 | — | — | 0.04 | 0.04 | 0.04 | 0.04 | 0.04 | 0.04 | 0.04 |
| Plastic Microballoons | — | 0.21 | 0.21 | — | — | — | — | — | — | — | — | — |
| Emulsion/Particles Ratio | 100/0 | 0/100 | 50/50 | 100/0 | 100/0 | 0/100 | 50/50 | 50/50 | 60/40 | 70/30 | 80/20 | 90/10 |
| Calculated Data[1] | | | | | | | | | | | | |
| Oxygen Balance (%) | −5.90 | −0.48 | −3.19 | −1.99 | −1.42 | +0.02 | −1.00 | 0.71 | −0.84 | −0.99 | −1.13 | −1.27 |
| Energy (kcal/kg)[2] | 647 | 1240 | 943 | 792 | 813 | 1248 | 1020 | 1031 | 987 | 944 | 900 | 857 |
| Relative Weight Strength[3] | 0.78 | 1.44 | 1.12 | 0.93 | 0.96 | 1.45 | 1.20 | 1.21 | 1.16 | 1.11 | 1.06 | 1.01 |
| Maximum Density (g/cc)[1] | 1.14 | 1.63 | 1.34 | 1.38 | 1.64 | 1.85 | 1.58 | 1.73 | 1.71 | 1.69 | 1.67 | 1.66 |
| Maximum Velocity (km/s)[4] | 5.80 | 6.58 | 6.28 | 6.35 | 7.28 | 7.19 | 6.79 | 7.32 | 7.32 | 7.32 | 7.30 | 7.31 |
| Pressure at Maximum Velocity (kbar) | 108 | 181 | 144 | 150 | 222 | 233 | 189 | 232 | 230 | 228 | 226 | 225 |
| Measured Density (g/cc) | 0.99 | 1.60 | 1.23 | 1.19 | 1.43 | 1.80 | 1.38 | 1.57 | 1.48 | 1.46 | 1.44 | 1.44 |
| Velocity Calculated at Measured Density (km/s) | 5.34 | 6.50 | 5.95 | 5.78 | 6.64 | 7.05 | 6.22 | 6.85 | 6.64 | 6.63 | 6.61 | 6.65 |
| Pressure Calculated at Measured Density (kbar) | 82 | 174 | 121 | 112 | 168 | 220 | 144 | 191 | 173 | 170 | 168 | 170 |

[1]Using computer code.
[2]Qtotal.
[3]ANFO = 1.00 at 0.82 g/cc.
[4]Calculated at maximum density.

TABLE 6

| | Mix 1 | Mix 2 | Mix 3 | Mix 4 |
|---|---|---|---|---|
| Particle Size | Small[1] | Large[2] | Small[1] | Large[2] |
| Emulsion Phase[3] | 80 | 80 | 66.7 | 66.7 |
| Cast Particles[4] | 20 | 20 | 33.3 | 33.3 |
| Oxygen Balance (%) | | | | |
| Density (g/cc) | 1.51 | 1.51 | 1.54 | 1.54 |
| Results | | | | |
| MB, 50 mm, −20° C. (Det/Fail) | #3/#2 | #4/#3 | #2/#1 | #2/#1 |
| $d_c$, 20° C., Det/Fail (mm) | 25/— | 32/25 | 25/— | 25/— |
| D, #12, 20° C. (km/s) | | | | |
| 50 mm | 3.84 | 5.85 | 4.86 | 4.86 |
| 38 mm | 3.39 | 3.31 | 4.54 | 4.29 |
| 32 mm | 3.32 | 1.54 | 4.32 | 4.30 |
| 25 mm | 2.64 | Fail | 3.92 | 3.98 |

[1]Hemispherical shape, 10 mm diameter.
[2]Hemispherical shape, 13 mm diameter.
[3]AN (67.87), SN (17.11), Urea (4.32), Water (4.70), polymeric emulsifier (1.26), mineral oil (2.94), Amber Wax (0.9), Paraffin Wax (0.9).
[4]NaP (71.30), DEG (24.55), Water (3.99), TEG (0.12), Gum (0.04).

TABLE 7

| | 1 | 2 | 3 |
|---|---|---|---|
| Emulsion[1] | 80.00 | 75.00 | 66.67 |
| Cast Particles[2] | 20.00 | 25.00 | 33.33 |
| Oxygen Balance (%) | −0.58 | −0.54 | −0.48 |
| Density (g/cc) | 1.44 | 1.45 | 1.49 |
| Results at 5° C. | | | |
| MB, 50 mm (Det/Fail) | #2/#1 | #2/#1 | #2/#1 |
| D, #12 (km/s) | | | |
| 75 mm | 4.0 | 4.4 | 4.6 |
| 63 mm | 3.5 | 4.2 | 4.7 |
| 50 mm | 3.6 | 4.0 | 4.4 |
| 38 mm | 3.2 | 3.5 | 4.0 |
| Results at −20° C. | | | |
| MB, 50 mm (Det/Fail) | #3/#2 | #2/#1 | #2/#1 |
| D, #12 (km/s) | | | |
| 75 mm | 4.1 | 4.2 | 4.8 |
| 63 mm | 4.3 | 4.3 | 4.8 |
| 50 mm | 3.7 | 3.8 | 4.3 |
| 38 mm | 2.8 | 5.1 | 3.8 |

[1]AN (70.20), SN (13.01), $H_2O$ (10.39), polymeric emulsifier (1.34), mineral oil (3.14), Amber Wax (0.96), Paraffin Wax (0.96)
[2]NaP (71.30), DEG (24.55), $H_2O$ (3.99), TEG (0.12), Xanthan Gum (0.04). Hemispherical shape, 10 mm diameter.

TABLE 8

| | 1 | 2 | 3 |
|---|---|---|---|
| Emulsion Phase[1] | 66.67 | 66.67 | 66.67 |
| Cast Particles[2] | 33.33 | 33.33 | 33.33 |
| Age of Particles (hours) | 2 | 4 | >48 |
| Oxygen Balance (%) | −0.48 | −0.48 | −0.48 |
| Density (g/cc) | 1.44 | 1.45 | 1.49 |
| Results | | | |
| Temperature (° C.) | 50 | 30 | 50 |
| MB, 50 mm (Det/Fail) | #2/#1 | #2/#1 | #2/#1 |
| D, #12 (km/s) | | | |
| 75 mm | 4.4 | 4.4 | 4.4 |
| 63 mm | 4.2 | 4.1 | 4.3 |
| 50 mm | 3.6 | 4.0 | 4.4 |
| 38 mm | 3.4 | 3.5 | 4.1 |

[1]AN (70.20), SN (13.01), $H_2O$ (10.39), polymeric emulsifier (1.34), mineral oil (3.14), Amber Wax (0.96), Paraffin Wax (0.96)
[2]NaP (71.30), DEG (24.55), $H_2O$ (3.99), TEG (0.12), Xanthan Gum (0.04). Hemispherical shape, 10 mm diameter.

What is claimed is:

1. A cap-sensitive, high energy emulsion explosive having high detonation velocity and pressure comprising a mixture of:

a) from about 25% to about 95% by weight of an emulsion phase comprising (1) a continuous organic liquid fuel phase; (2) a discontinuous inorganic oxidizer solution phase of ammonium nitrate and water; and (3) an emulsifier, and b) from about 5% to about 75% by weight of cast particles comprising a mixture of from about 50% to about 80% anhydrous sodium perchlorate, from about 0% to about 10% water and from about 10% to about 40% diethylene glycol.

2. An explosive according to claim 1 wherein the cast particles further contain a thickening agent.

3. An explosive according to claim 1 wherein the emulsion phase further contains from about 0.1% to about 6% microballoons.

4. An explosive according to claim 1 wherein the cast particles further contain from about 0.01% to about 4% microballoons.

5. An explosive according to claim 1 wherein the cast particles further contain up to about 1% triethylene glycol.

6. An explosive according to claim 1 having a density of greater than about 1.4 g/cc.

7. A cap-sensitive, high energy emulsion explosive having high detonation velocity and pressure comprising a mixture of:

a) from about 40% to about 85% by weight of an emulsion phase comprising (1) a continuous organic liquid fuel phase; (2) a discontinuous inorganic oxidizer solution phase of ammonium nitrate and water; and (3) an emulsifier, and b) from about 15% to about 60% cast particles, by weight of cast particles comprising a mixture of from about 50% to about 80% anhydrous sodium perchlorate, from about 0% to about 10% water and from about 10% to about 40% diethylene glycol.

8. A cap-sensitive, high energy emulsion explosive having high detonation velocity and pressure comprising a mixture of:

a) from about 50% to about 75% by weight of an emulsion phase comprising (1) a continuous organic liquid fuel phase; (2) a discontinuous inorganic oxidizer solution phase of ammonium nitrate and water; and (3) an emulsifier, and b) from about 25% to about 50% cast particles, by weight of cast particles comprising a mixture of from about 50% to about 80% anhydrous sodium perchlorate, from about 0% to about 10% water and from about 10% to about 40% diethylene glycol.

* * * * *